US007564328B2

(12) United States Patent
Engel et al.

(10) Patent No.: US 7,564,328 B2
(45) Date of Patent: Jul. 21, 2009

(54) THERMAL EXPANSION COMPENSATION ASSEMBLIES

(75) Inventors: Klaus Gunter Engel, Waterloo (CA); Mihai Vladimirescu, Cambridge (CA)

(73) Assignee: Com Dev International Ltd., Cambridge (CA)

( * ) Notice: Subject to any disclaimer, the term of this patent is extended or adjusted under 35 U.S.C. 154(b) by 0 days.

(21) Appl. No.: 12/389,418

(22) Filed: Feb. 20, 2009

(65) Prior Publication Data

US 2009/0153274 A1 Jun. 18, 2009

Related U.S. Application Data

(62) Division of application No. 11/543,062, filed on Oct. 5, 2006.

(51) Int. Cl.
*H01P 1/207* (2006.01)
*H01P 3/12* (2006.01)

(52) U.S. Cl. ..... 333/239; 333/209; 333/234

(58) Field of Classification Search ..... 333/202, 333/239, 209, 234, 229
See application file for complete search history.

(56) References Cited

U.S. PATENT DOCUMENTS 4,178,562 A * 12/1979 Torma et al. ..... 331/84

* cited by examiner

*Primary Examiner*—Stephen E Jones
(74) *Attorney, Agent, or Firm*—Bereskin & Parr LLP; Isis E. Caulder

(57) ABSTRACT

Filter and manifold compensation assemblies for thermal compensation of a filter cavity and a manifold which include at least one a lever element pivotally coupled to the filter or manifold at a first pivot point, an anchoring element pivotally coupled to the lever element at the second pivot point and secured to the housing of the filter or manifold, and a thermal expansion element having a lower coefficient of thermal expansion than the filter cavity or manifold and pivotally coupled to the lever element. The relative thermal expansion of the thermal expansion element in comparison with the thermal expansion of the filter or manifold causes the lever element to articulate and to displace the housing for thermal compensation. The degree of each displacement is proportional to the ratio between the distance between the second and first pivot points and the distance between the second and the third pivot points.

7 Claims, 9 Drawing Sheets

THERMAL EXPANSION COMPENSATION ASSEMBLIES

This application is a divisional application of U.S. patent application Ser. No. 11/543,062 filed on Oct. 5, 2006.

FIELD

The embodiments described herein relate to multiplexers and more particularly to a thermal expansion compensation assembly for filters and manifolds.

BACKGROUND

A ubiquitous element of current fixed service satellite repeaters is the output multiplexer (also called "mux"). An output multiplexer filters the individual signals received from multiple high power amplifiers and combines them into a composite waveform that is routed to the antenna beam formers via a single transmission line. FIG. 1 illustrates a conventional output multiplexer 5 and shows the filters 7, comprised of resonant structures, and the manifold 9 into which signals are injected and combined. Of special note is that the filters 7 interface directly with the manifold 9, without any intermediate provision to isolate the filter function from the combining function. This form achieves considerable economies of size and power efficiency, but results in a highly complex design that must be optimized and aligned as a whole because of the extreme interdependence of all constituent parts. Accordingly, output multiplexers are inherently sensitive structures.

Dimensional stability is paramount to the proper functioning of an output multiplexer. A dimensional change in the resonant structure of a filter, due to thermal expansion, alters the passband frequency. Changes in manifold dimensions degrade the filter performance because of the skewed match. Output multiplexers have been traditionally fabricated from very low expansion steel alloys of which Invar, with a coefficient of thermal expansion (CTE) near 1 part per million per Celsius degree (ppm/C.°), is most common. As conventionally known, the coefficient of thermal expansion (CTE) is generally defined as the fractional increase in length per unit rise in temperature.

Two substantial commercial forces are influencing the design of output multiplexers. First, increasing traffic volume is necessitating maximum use of the available radio spectrum. A high power signal incident on the band edge of a filter represents a potentially damaging fault condition, therefore, any uncertainty in the location of the edges due to filter drift renders that part of the passband unusable. Second, high traffic densities and/or direct broadcast applications require increased power levels within output multiplexers, creating ever harsher thermal environments.

In the face of these trends, even the modest expansion of Invar equipment begs improvement. However, with currently employed power levels upwards of 450 Watts per channel, the design space becomes severely constrained. Invar exhibits poor thermal conduction properties, which lead to self-defeating high temperatures. Temperatures of some extant designs approach the limits of the output multiplexer materials. Alternate low CTE materials, such as carbon fiber composites, share this conduction deficiency. Additionally, Invar has undesirably high mass density. Aluminum is a preferred material in general spacecraft application because of its lightness, strength, and excellent thermal conductivity. However, aluminum also has a noteably high CTE of 23.4 ppm/C.°, which is untenable in a conventional output multiplexer application.

Contending with the heightened thermal flux requires a superior path to a heat sink. Structural elements that support output multiplexers and sink the heat are invariably made of aluminum. Securely fixing a low coefficient of thermal expansion (CTE) output multiplexer to an aluminum support, results in intolerable stress in the presence of temperature changes. Historically, Invar output multiplexers have been mounted by means of flexible brackets that alleviate the thermal stress, but in the high power regime such necessarily minimal sections present an unacceptable heat flow bottleneck.

In view of the above-noted design constraints, an aluminum output multiplexer is highly desirable in a high power regime and is well suited in every aspect except in the dimensional stability of the radio frequency boundaries. What is needed is a means of compensating for the radio frequency effects of thermal expansion associated with an aluminum output multiplexer.

This filter compensation problem has been widely examined over the years. High power filters typically consist of free space cylindrical cavities with tuning screws that penetrate the cylinder walls for fine frequency adjustment. Proposed or embodied compensation solutions generally fall into three categories each having their own limitations.

One compensation approach is disclosed in U.S. Pat. No. 4,677,403 to Kich et al. that describes the use of multiple filter structures where the tuning screw, or similar field perturbing element, penetration or diameter varies with temperature. The wave mechanics of the resonator require that the penetration of the tuning screw reduce as the cavity temperature rises, therefore, merely selecting a material with a complimentary coefficient of thermal expansion (CTE) is not an option. These multiple filter structures typically use bimetal springs or shape memory alloys to manipulate the screw penetration. However, in very high power regimes the tuning screw itself is a locale of significant radio frequency energy dissipation and because it is small is therefore subject to large temperature change. Such local temperature may not adequately track the temperature change of the entire cavity, which is what determines the frequency behavior. Also, in dual mode cavities, individual compensating screws are required for the orthogonal modes. These features must track each other very precisely in order to preserve filter alignment, a very difficult attribute to maintain in practice.

Other compensation approaches involve deforming the end wall of a cylindrical cavity in order to change its apparent length as disclosed in U.S. U.S. Pat. No. 6,433,656 to Wolk et al., U.S. Pat. No. 6,535,087 to Fitzpatrick et al. and U.S. Pat. No. 6,002,310 to Kich et al. These variations include bimetal diaphragms or constraining devices (rings or braces) made of a contrasting CTE material that impose forces on a flexible end wall. However, these devices operate locally and respond to thermal effects in the immediate vicinity of the compensating end wall. Temperature gradients along the cavity length, which are increasingly significant at elevated power levels, are not integrated. Also, all the mechanisms realize the motive force through flexures. The features or parts that cause the compensating motion do so under bending from thermal stress. Consequently, the nature and degree of movement is highly sensitive to variabilities in the material modulus and/or the part dimensions. Interim thermal testing and adjustment are generally required. Further, flexure based mechanisms tend to create non-linear movement with respect to temperature, where a linear response is more desirable. Finally, all the present mechanisms have limitations of the range of motion available. Higher temperatures or longer cavities require increasingly long strokes of the diaphragm.

Another compensation approach addresses the distinct, but related problem of maintaining constant separation of reactive elements in a transmission line and is disclosed in U.S. Pat. No. 5,428,323 to Geissler et al. and U.S. Pat. No. 6,897,746 to Thomson et al. This compensation mechanism is based on the dispersion property of rectangular waveguide. The effective wavelength of a signal, within a rectangular waveguide, depends upon the larger "a" dimension of the waveguide such that a narrowing of the waveguide increases the wavelength of signals present. However, expansion of the manifold along its length alters the spacing between filters, which disturbs the very critical spatial separation of the channel filters. These important spatial relationships are determined by the signal phase differentials between the junctions. Increasing the wavelengths of the signals at similar rate as the manifold lengthens by thermal expansion negates the consequences of thermal expansion. This compensation is achieved by causing the narrow wall of the waveguide to bend inwards (in response to heating) or outward (in response to cooling). However, there are several limitations of this approach associated with the design challenges of a practical embodiment. The wall that must be bent is the small wall and accordingly is inherently resistant to deformation. It is difficult to compensate without excessive forces or unreasonably thin wall thickness. Also, to operate successfully, bending of the wall needs to be highly uniform over the affected length of the manifold adding to these difficulties.

SUMMARY

The embodiments described herein provide in one aspect, a filter compensation assembly for thermal compensation of a filter cavity assembly having an end wall and a housing, said assembly comprising:

(a) a lever element having a first pivot point at one end, a second pivot point at the other end and a third pivot point positioned in between the two ends, where the lever element is pivotally coupled at the first pivot point to the end wall;

(b) an anchoring element pivotally coupled to the lever element at the second pivot point and secured to the housing of the filter cavity;

(c) a thermal expansion element having a lower coefficient of thermal expansion than the filter cavity assembly, said thermal expansion element having one end pivotally coupled to the lever element at the third pivot point and the other end secured to the housing of the filter cavity;

(d) such that the difference in the coefficient of thermal expansion between the thermal expansion element and the filter cavity assembly causes the lever element to articulate and to displace the end wall to achieve thermal compensation and wherein the degree of displacement of the end wall caused by the lever element is proportional to the ratio between the distance between the second and first pivot points and the distance between the second and the third pivot points.

The embodiments described herein provide in another aspect, a manifold compensation assembly for thermal compensation of a manifold enclosing a rectangular waveguide, having thin and compliant narrow walls and rigid broad walls, said manifold compensation assembly comprising:

(a) first and second lever elements, each having a first pivot point at one end, a second pivot point at the other end and a third pivot point positioned in between the two ends, where the first lever element is pivotally coupled at the first pivot point to the manifold on one of the narrow walls and the second lever element is pivotally coupled at the first pivot point on the opposite narrow wall;

(b) at least one anchoring element pivotally coupled between the first and second lever elements at the second pivot points of said first and second lever elements such that the at least one anchoring element is secured to a rigid broad wall; and (c) a thermal expansion element having a coefficient of thermal expansion that is less than that of the manifold assembly, said thermal expansion element being pivotally coupled between the first and second lever elements at the third pivot points of said first and second lever elements;

(d) such that the difference in the coefficient of thermal expansion between the thermal expansion element and the manifold assembly causes the first and second lever elements to articulate and to displace the narrow wall of the manifold to achieve thermal compensation and wherein the degree of displacement of the narrow walls caused by each of the first and second lever elements is proportional to the ratio between the distance between the second and first pivot points and the distance between the second and the third pivot points.

Further aspects and advantages of the invention will appear from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show at least one exemplary embodiment, and in which.

Figure 1:
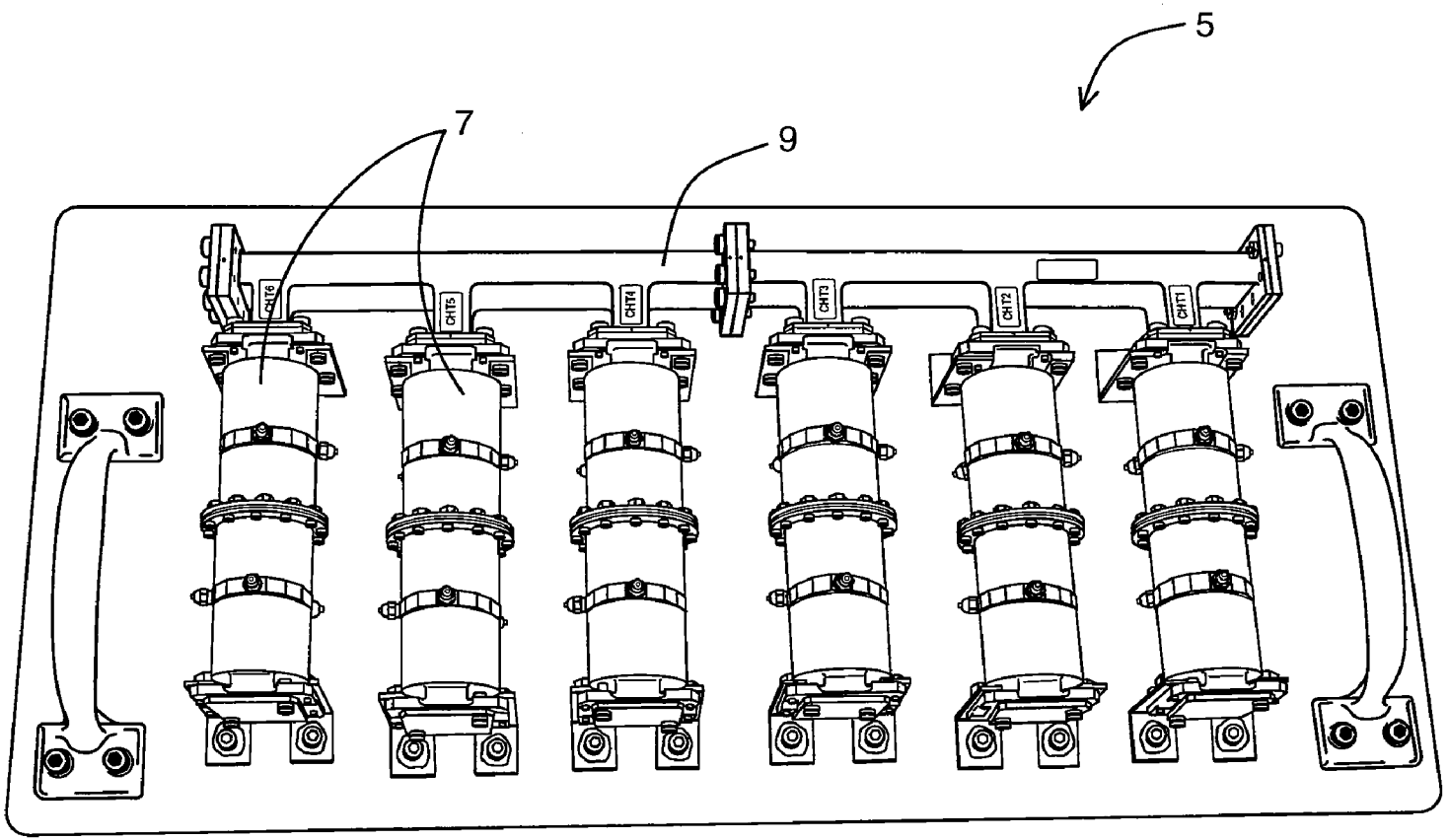
FIG. 1 PRIOR ART
FIG. 1 is a conventional prior art output multiplexer.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

It will be appreciated that for simplicity and clarity of illustration, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein, but rather as merely describing the implementation of the various embodiments described herein.

Figure 2A:
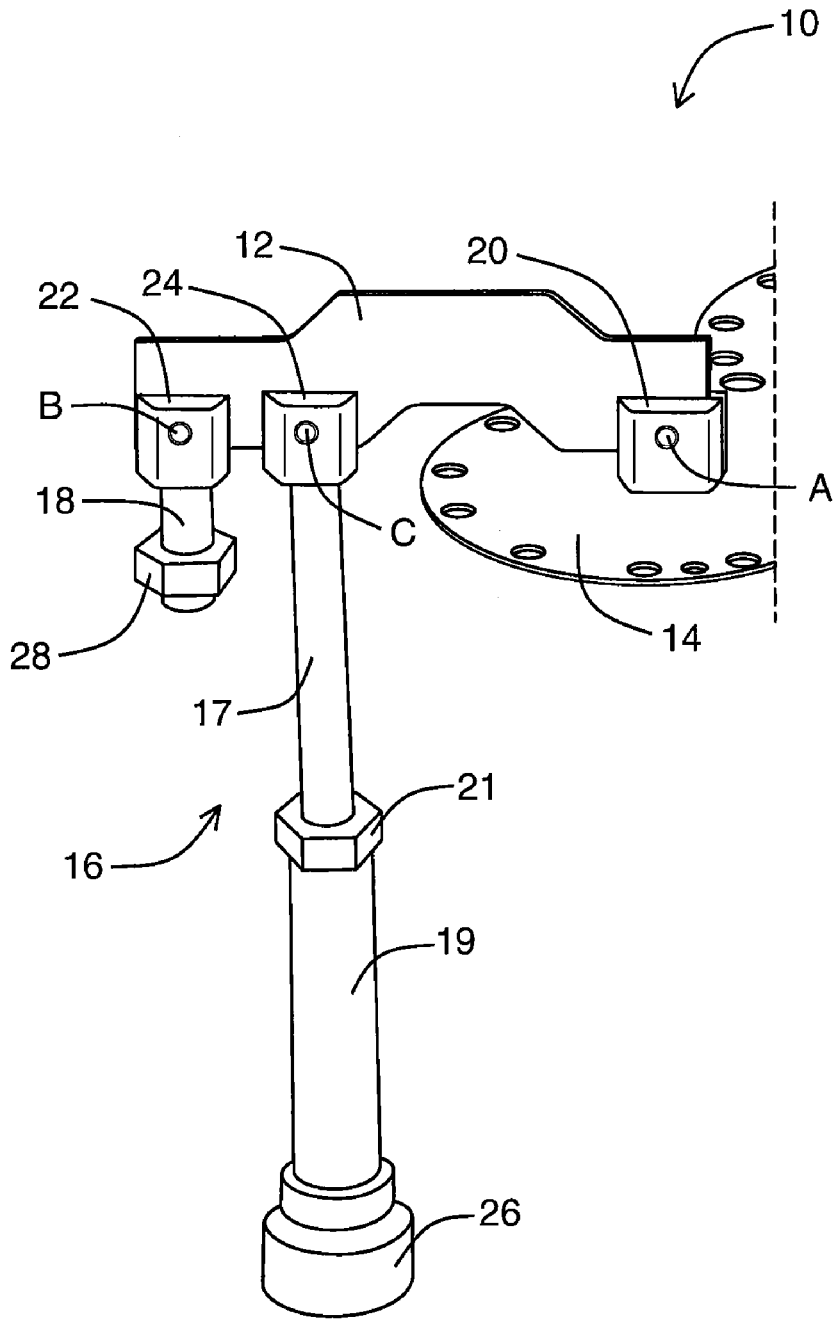
FIG. 2A is a front perspective view of an exemplary embodiment of a filter compensation assembly.
Figure 2B:
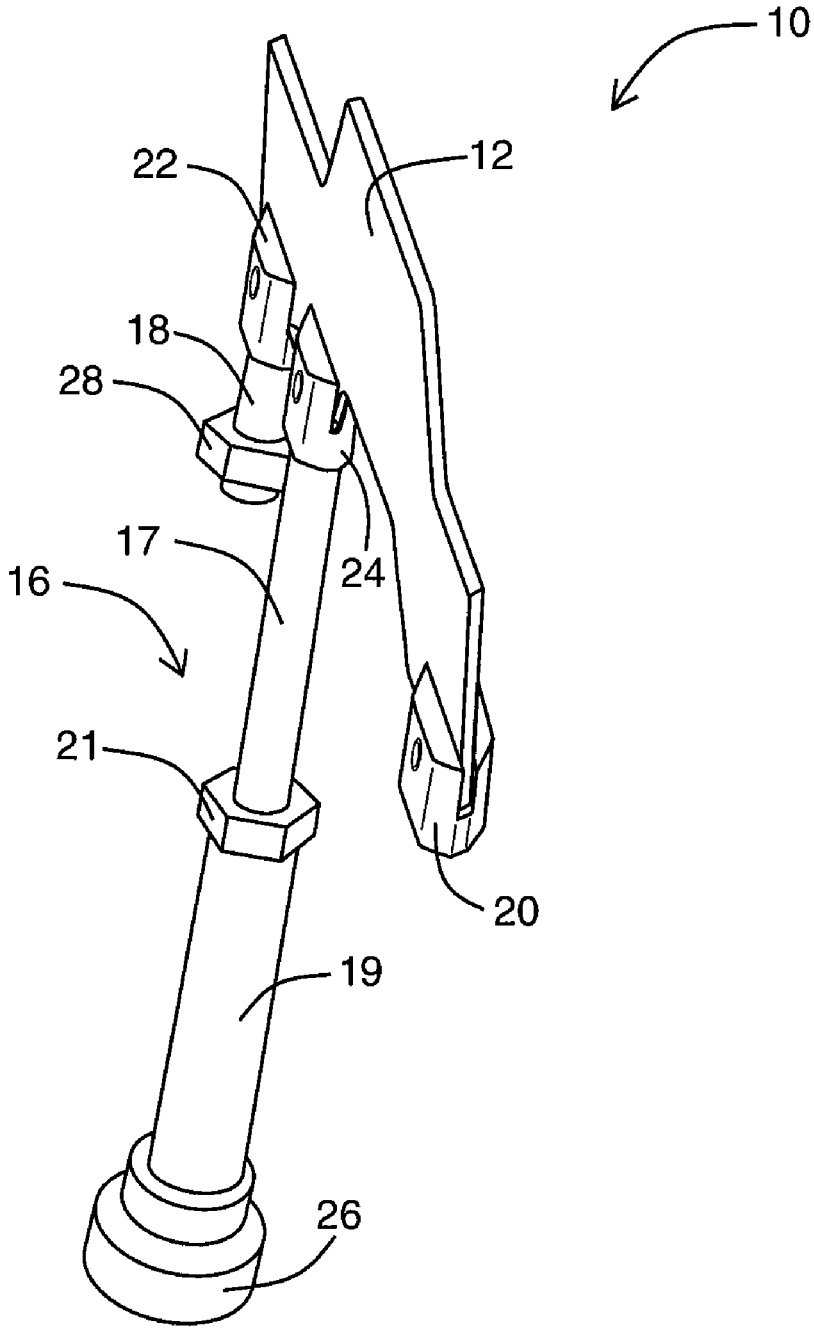
FIG. 2B is top rear perspective view of the filter compensation assembly of FIG. 2A.

FIGS. 2A and 2B illustrate a filter compensation assembly 10 in one exemplary embodiment. The filter compensation assembly 10 includes a lever element 12, a thermal expansion element 16, and an anchoring element 18. The lever element 12 is pivotally coupled to a membrane section 14 associated with a cavity end wall, the thermal expansion element 16 and the anchoring element 18. The filter compensation assembly 10 is designed to deform the membrane section 14 associated with an end wall of a cavity filter assembly 30 in order to compensate for (i.e. negate) the effects of thermal expansion, as will be described in detail.

The lever element 12 is a substantially flat section with three pivot openings formed therein located at pivot points A, B and C. Accordingly, the lever element 12 is designed to be coupled to the membrane section 14, the anchoring element 18 and the thermal expansion element 16 at the three pivot points A, B and C, respectively as shown in FIG. 2A. Specifically, the lever element 12 is pivotally coupled to the membrane section 14 (of the end wall of a filter cavity assembly 30) at pivot point A through a pivoting connector 20. The lever element 12 is pivotally coupled to the anchoring element 18 at pivot point B through a pivoting connector 22. Finally, the lever element 12 is pivotally coupled at pivot point C to the thermal expansion element 16 using a pivoting connector 24.

The lever element 12 is preferably manufactured out of a material with high tensile strength and stiffness (e.g. steel). The lever element 12 is sized sufficiently large to have negligible elastic deformation under the reaction loads from the cavity end wall. In this way, the compensation rate is a function only of the geometry and the CTE of constituent parts and therefore is predictable and controllable to a high precision. Any structural material of suitable stiffness may be employed with ANSI 440-C stainless steel being preferred because of its superior bearing qualities at the pivot points A, B and C.

The lever element 12 is slotted at the end at which it pivotally connects to membrane section 14 (FIGS. 3B and 3C) to allow for radial expansion of the filter cavity assembly 30 and to allow the filter compensation assembly 10 to be fitted after filter tuning and stabilization. The coefficient of thermal expansion (CTE) of the lever element 12 is inconsequential since the slotted pivot hole at pivot A (FIGS. 3B, 3C) is designed to accommodate the radial expansion of the filter cavity assembly 30. Accordingly, the lever element 12 is designed to predictably transfer the relative motion of the thermal expansion element 16 to the membrane section 14 of the cavity filter assembly 30.

The thermal expansion element 16 is coupled at pivot point C to the lever element 12 through the pivoting connector 24 (FIG. 2A). The thermal expansion element 16 is preferably a two-piece element that has a top section 17 and a bottom section 19 which are coupled together, preferably by threading the top section 17 inside the bottom section 19 and securing the engagement using a suitable locking device 21 such as a jam-nut (e.g. standard screw and bolt fastener). The top section 17 and the bottom section 19 are each preferably rod-shaped, however it should be understood that they could be of any suitable shape and/or cross-section.

Generally speaking, the top section 17 and bottom section 19 of the thermal expansion element 16 are both manufactured from material or materials that have a relatively low coefficient of thermal expansion (CTE) in relation to the cavity filter assembly 30 as will be discussed. Specifically, the top section 17 of thermal expansion element 16 is preferably manufactured from a material such as Invar having a coefficient of thermal expansion preferably in the range of 0.7 to 1.5 ppm/C.°. The bottom section 19 is preferably manufactured of the same material (e.g., Invar).

The bottom section 19 has a locating feature such as a shoulder (not shown) formed at the end of the bottom section 19 and which is adapted along with an mounting element 26 to securely couple the filter compensation assembly 10 to the bottom portion of the housing of a cavity filter assembly 30.

Figure 3A:
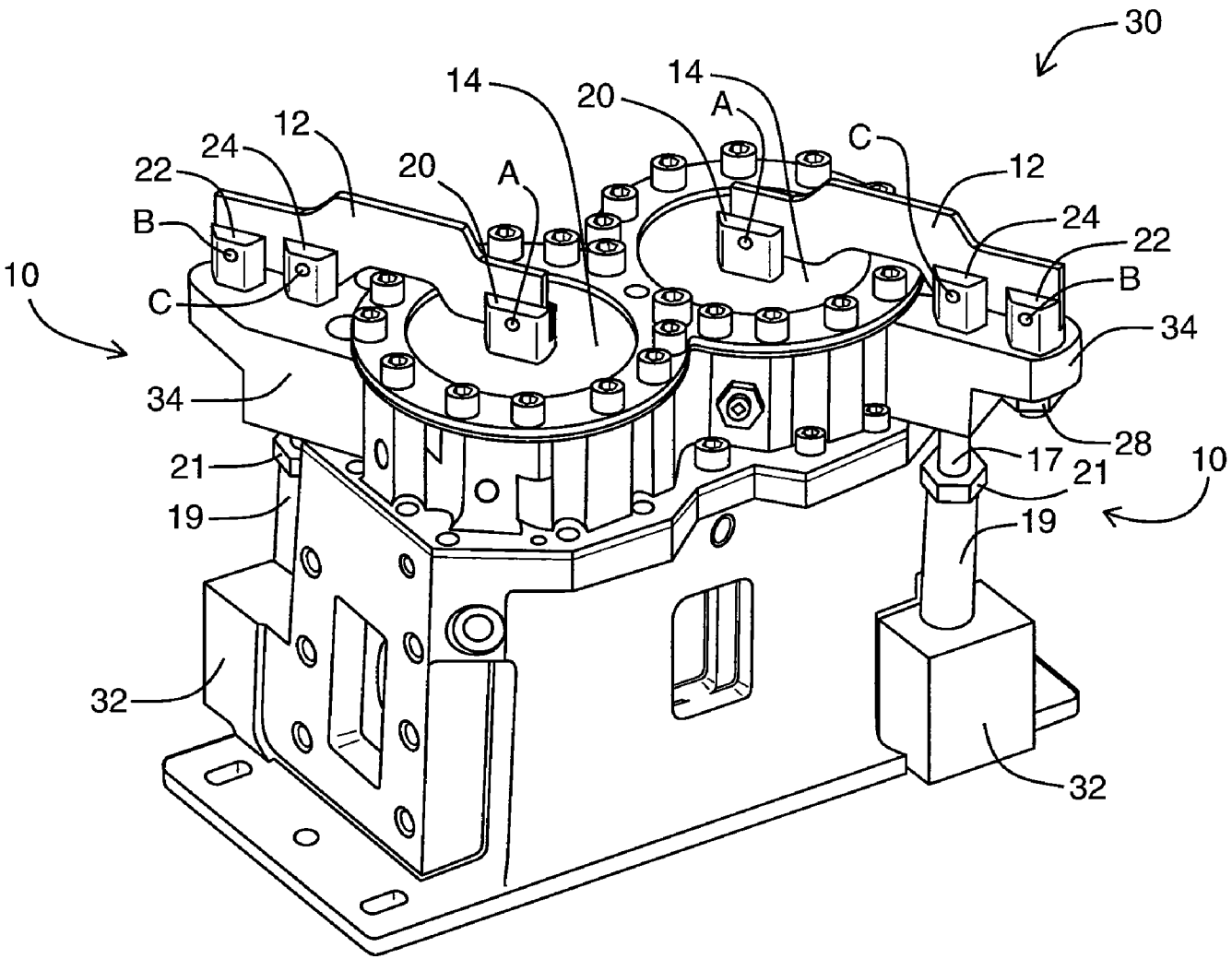
FIG. 3A is a side perspective view of two filter compensation assemblies of FIG. 2A installed on an exemplary cavity filter assembly.
Figure 3B:
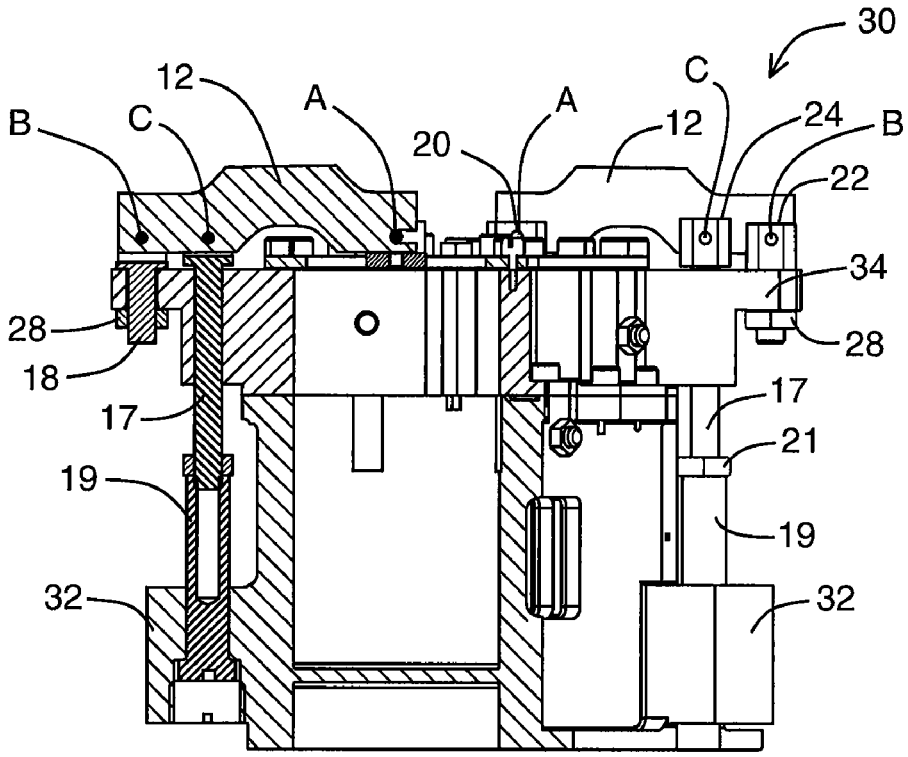
FIG. 3B is a front cross-sectional view of two filter compensation assemblies of FIG. 2A installed on a cavity filter assembly in the absence of thermal expansion.
Figure 3C:
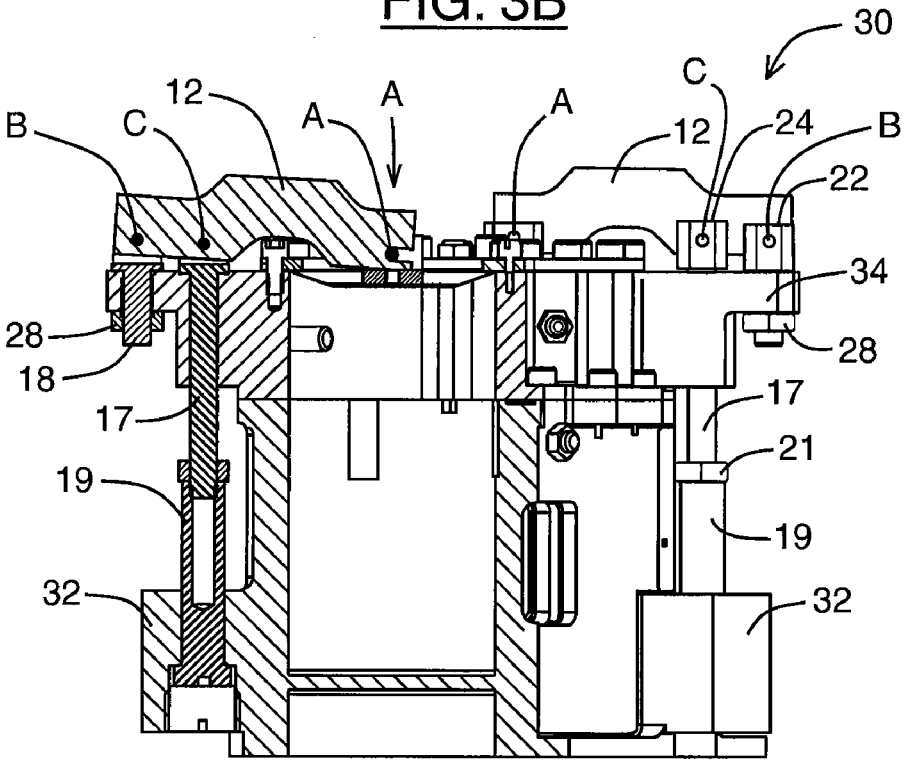
FIG. 3C is a front cross-sectional view of the filter compensation assembly of FIG. 2A installed on a cavity filter assembly in the presence of thermal expansion.

This is achieved by means of contact between the shoulder 26 and a land surface within the anchoring boss of cavity filter assembly 30 (FIGS. 3B, 3C). A separate mounting element 26 in the form of a threaded plug assures that the anchoring shoulder and land surface of the anchoring boss of cavity filter assembly 30 remain in intimate contact at all times even when the thermal expansion element is in compression as would be the case at low temperature. Mounting element 26 is preferably manufactured from conventional steel for threaded fasteners, the CTE having minimal significance.

The two-piece design of the thermal expansion element 16 allows for the necessary assembly adjustments to mitigate the effect of a combination of manufacturing tolerances and permits the identical thermal expansion element to be applied to a range of different cavity lengths. While the thermal expansion element 16 could be of unitary design, the two-piece construction is highly advantageous because of the adjustments permitted.

While the top section 17 and the bottom section 19 are described above as both being manufactured out of a common material such as Invar, the inventors have observed that it is difficult to thread Invar material into Invar material because of the softness of the material. An alternative is to make one of the top section 17 and the bottom section 19 out of a material such as Invar and design it as long as possible dimensionally and make the companion part out of a harder material (e.g. steel) and as short dimensionally as possible. The underlying concept of this strategy would be that the short part would be optimized for strength but contributes little absolute expansion because of the minimum length. Another alternative for the thermal compensation element 16 to be manufactured as a single piece with an external thread positioned at the end that corresponds to the housing restraining element 32. A threaded nut fattener is then used to secure the thermal compensation element 16 to the restraining element 32 with adjustment provided by inserting shims under the fastener.

Also, it should be noted the thermal expansion element 16 is provided outside the cavity filter assembly 30 and is not strongly bound to the cavity in terms of heat flow. Therefore the thermal expansion element 16 can deviate in temperature from the cavity filter assembly 30 depending on application specific thermal boundary conditions. For this reason, the preferred material for the thermal expansion element 16 is Invar that is sufficiently near zero CTE that the temperature deviation is not of significant consequence. Thermal expansion element 16 can be manufactured out of higher CTE but this requires custom design.

Finally, the relatively long dimension of the thermal expansion element 16 in relation to the other elements of the filter compensation assembly 10 reduces the sensitivity of the filter compensation assembly 10 to manufacturing tolerances. This is because the compensation rate is proportional to the length of the length of thermal expansion element 16. The only other critical elements to maintaining controlled compensation rate are the locations of the pivot points A, B, and C on lever 12, which are can be readily controlled.

The anchoring element 18 is utilized to secure the filter compensation assembly 10 to the housing of the cavity filter assembly 30 as will be discussed. The anchoring element 18 is preferably a relatively short rod, however, it should be understood that anchoring element 18 could be of any suitable shape and/or cross-section. The anchoring element 18 includes a restraining element 28 which is positioned near the end of the anchoring element 18 and which is adapted to securely couple the filter compensation assembly 10 to the top portion of a filter housing at pivot point B. The anchoring element 18 is preferably manufactured from a material with substantial tensile strength (e.g. steel) to ensure stability. The restraining element 28 is sufficiently small that the CTE of the material does not significantly affect the compensation mechanism.

Now referring to FIGS. 3A, 3B and 3C, the application of two identical filter compensation assemblies 10 to a Ku band four pole (two dual mode cavities) filter assembly 30 will be discussed. FIGS. 3A and 3B illustrate the baseline configuration (i.e. in the absence of thermal expansion) of two filter compensation assemblies 10 as implemented within a Ku band four pole (two dual mode cavities) filter cavity assembly 30. FIG. 3C illustrates two filter compensation assemblies 10 as implemented within a Ku band four pole (two dual mode cavities) filter cavity assembly 30 in the presence of thermal expansion. FIGS. 3B and 3C are cross-sectional views with the sectional plane being in the middle of the lever element 12.

As shown, the filter cavities are arranged such that the longitudinal dimension of the filter cavities are arranged in a parallel orientation and there is internal coupling through the side walls (not shown). The cavity filter assembly 30 is typically manufactured from aluminum with a relatively high CTE. As previously discussed, each filter compensation assembly 10 provides a driving mechanism that consists of the thermal expansion element 16 having a low CTE which in the presence of temperature increase, causes the lever element 12 to bear down onto the membrane section 14 (i.e. the cavity end wall) of the filter cavity assembly 30. Conversely, in the presence of a temperature decrease, the mechanism causes the lever element 12 to pull up on the membrane section 14.

These actions of the compensating mechanism of the filter compensation assembly 10 are described relative to a quiescent flat condition of the membrane section 14. Possible alternative embodiments of the mechanism include cases where the filter compensation assembly 10 is initially installed in a pre-stressed condition where the membrane section 14 is initially deformed so that the mechanism action is to either pull or push only during operation in order to negate the effects on mechanism slop (or backlash).

As can be seen in FIGS. 3A, 3B and 3C, when the thermal expansion element 16 is installed within the filter assembly 30, the thermal expansion element 16 is positioned substantially parallel to the longitudinal axis of the resonant cavities of the filter assembly 30. Also, the thermal expansion element 16 is substantially equal in length to the filter cavity. These factors enable the filter compensation assembly 10 to compensate for the aggregate temperature change of the filter cavity, rather than a local region of the cavity as is typically the case in the prior art. This design provides more accurate compensation in high power applications where there are significant temperature gradients present along the length of the filter cavity.

As previously discussed, the mounting element 26 on the bottom section 19 of the thermal expansion element 16 is used to secure the filter compensation assembly 10 to the bottom housing of cavity filter assembly 30 and is specifically secured within a restraining element 32 as shown in FIG. 3A.

Also, as previously discussed, the anchoring element 18 is used to pivotally secure the filter compensation assembly 10 to the top portion of the housing of cavity filter assembly 30 through a pivoting connector 22 at pivot point B. Specifically, and as shown in FIG. 3A, the anchoring element 18 is positioned and secured within a restraining element 34 of filter assembly 30 through the use of the restraining element 28. In principal, the anchoring elements can be made integral with the restraining element 34 of the filter assembly by designing the restraining element to incorporate a pivoting connection point 22. In practice, however, separate restraining elements 28 and 34 are more practical to ease assembly and to afford the use of high stiffness material at the pivoting connection point 22. In the embodiment illustrated in FIGS. 3B and 3C, the anchoring element 18 is a threaded shaft passing through a hole in the restraining feature 34 secured with a restraining element 28 that is a standard nut.

Finally, the lever element 12 is pivotally coupled to the membrane section 14 of the cavity filter assembly 30 through pivoting connector 20 at pivoting point A.

As shown in FIGS. 2A, 2B, 3A, 3B and 3C, and as previously discussed, the lever element 12 is pivotally coupled to anchoring element 18 at pivot point B through pivoting connector 22. Also, the lever element 12 is pivotally coupled to the thermal expansion element 16 at an intermediate pivot point C using pivoting connector 24. Also, the lever element 12 is pivotally coupled to the center region of a membrane section 14 of the filter cavity assembly 30 at pivot point A using the pivoting connector 20.

As previously discussed, since the lever element 12 is slotted at the end where it meets the membrane section 14 (FIGS. 3B and 3C), the filter compensation assembly 10 can be fitted after filter tuning and stabilization. The initial alignment and adjustment of a filter often requires disassembly to access internal features, which process is greatly abetted by not requiring the integration of compensation at these initial stages.

As shown in FIG. 3C, increasing operating temperature causes thermal expansion of the filter cavity assembly 30 due to the relatively high coefficient of thermal expansion. Since the thermal expansion element 16 of the filter compensation assembly 10 has a relatively low coefficient of thermal expansion, a downward force is provided by the lever element 12 at the center region of the membrane section 14 (i.e. end wall) to negate the effects of thermal expansion within the filter cavity assembly 30. That is, the difference in the coefficient of thermal expansion (CTE) between the aluminum cavity filter assembly 30 (relatively high CTE) and the thermal expansion element 16 (relatively low CTE), causes the lever element 12 to articulate and to displace the membrane section 14 (i.e. end wall) of the cavity filter assembly 30 (FIG. 3C) to achieve thermal compensation.

Specifically, in the presence of an increase in operational temperature the thermal expansion element 16 will expand less relative to the aluminum cavity filter assembly 30 (FIG. 3C). As the aluminum cavity filter assembly 30 expands, the thermal expansion element 16 will remain relatively unaffected by the increase in operating temperature. Simultaneously, the thermal expansion element 16 will continue to be held in place by anchoring element 18 through lever element 12 and pivot points B and C.

Since the anchoring element 18 anchors one end of the lever element 12 at pivot point B, and since the thermal expansion element 16 does not expand as readily as the cavity filter assembly 30, the lever element 12 will exert downwards pressure on the membrane section 14 at pivot point A (as illustrated by arrow A in FIG. 3C). That is, in the presence of a temperature increase, the membrane section 14 is deformed by the lever element 12 at pivot point A in a manner that alters the effective length of the filter assembly cavity sufficiently to negate the resonant frequency change due to thermal expansion of the filter assembly cavity.

The filter compensation assembly 10 has freely moving pivot points that permit the mechanism to be arbitrarily stiff relative to the membrane section 14 and therefore highly deterministic in performance. In contrast, the prior art compensation assemblies employ bi-metal material or flexure structures to deform cavity end walls. In these designs, the cavity wall position is determined by an equilibrium of opposing elastic forces and specifically the restoring force of the cavity wall and the deforming forces of the thermally induced stresses. The precision of these kinds of compensation assemblies is dependent on the stiffness of the elements that are difficult to control in manufacture.

It should be noted that the design of the anchoring element 18 determines the degree of mechanical amplification at issue according to conventional principles of lever mechanical operation. Specifically, the difference between the lengthwise thermal expansion (or contraction) of the cavity filter assembly 30 and the expansion (or contraction) of the thermal expansion element 16 imparts a countervailing and larger displacement towards (or away from) the center of membrane section 14 of a magnitude equal to the expansion of the cavity filter assembly 14 times the ratio of the between pivot-point lengths B-A to B-C. This lever mechanism of the filter compensation assembly 10 amplifies the differential expansion (or contraction) of the various assembly elements, allowing for larger displacements than permitted in prior art devices, thereby accommodating greater temperature excursions that are inherent in high power applications.

In contrast, in many prior art compensation assemblies, both the motion inducing element (e.g. the low CTE element) and the target element (e.g. membrane) are designed to bend together. The main appeal of the present approach is that the motion inducing element is highly rigid, with all rotations achieved through pivots, so that the amount of mechanical compensation results from simple geometry calculations, such as the lever ratio, instead of a balance between opposing spring forces, which can be notoriously inconsistent in respect of material properties and manufacturing dimensions. Since the cavity wall must be displaced by more than the lengthwise thermal expansion of the cavity filter assembly 30 because radial expansion of the cavity filter assembly 30 affects the resonant frequency in a similar sense and must be compensated, the ability to amplify the relative size changes of the relevant elements of the filter compensation assembly 10 significantly extends the operating range of the mechanism in comparison with the prior art.

Finally, the mechanical action of the filter compensation assembly 10 is substantially more linear in nature than is the case in prior art compensation assemblies. The resonant frequency of a cylindrical cavity is proportional to the scale, therefore, the proportional change in frequency with temperature is precisely the same as the CTE of the material from which it is made. The resonant frequency is not proportional to length alone, but over the range of operation of the present invention, very closely approximates a linear relationship. Therefore, a compensation method where the compensation is directly proportional to expansion represents a preferred solution. Accordingly, the filter compensation assembly 10 is more effective in controlling the linear effects of thermal expansion then other conventional non-linear solutions.

Figure 4:
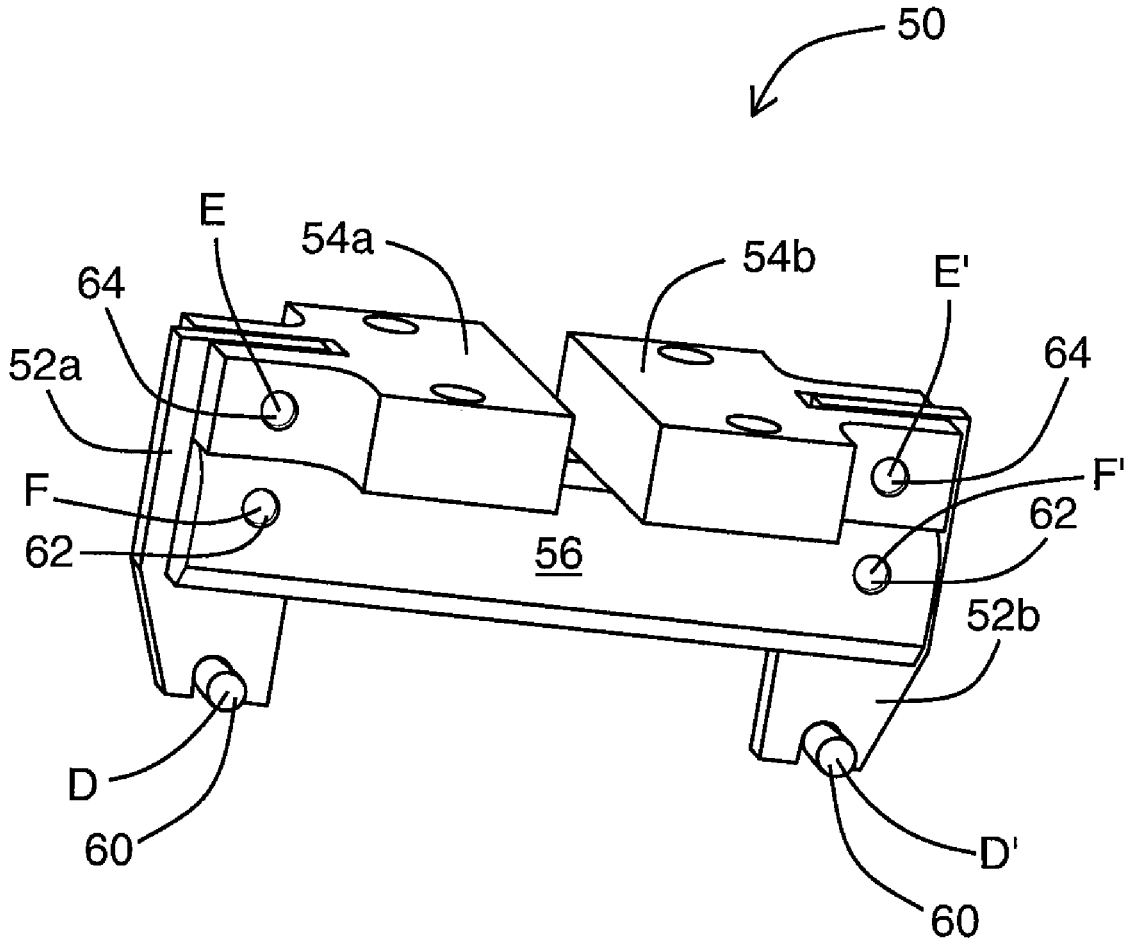
FIG. 4 is a front perspective view of an exemplary embodiment of a manifold compensation assembly.
Figure 5A:
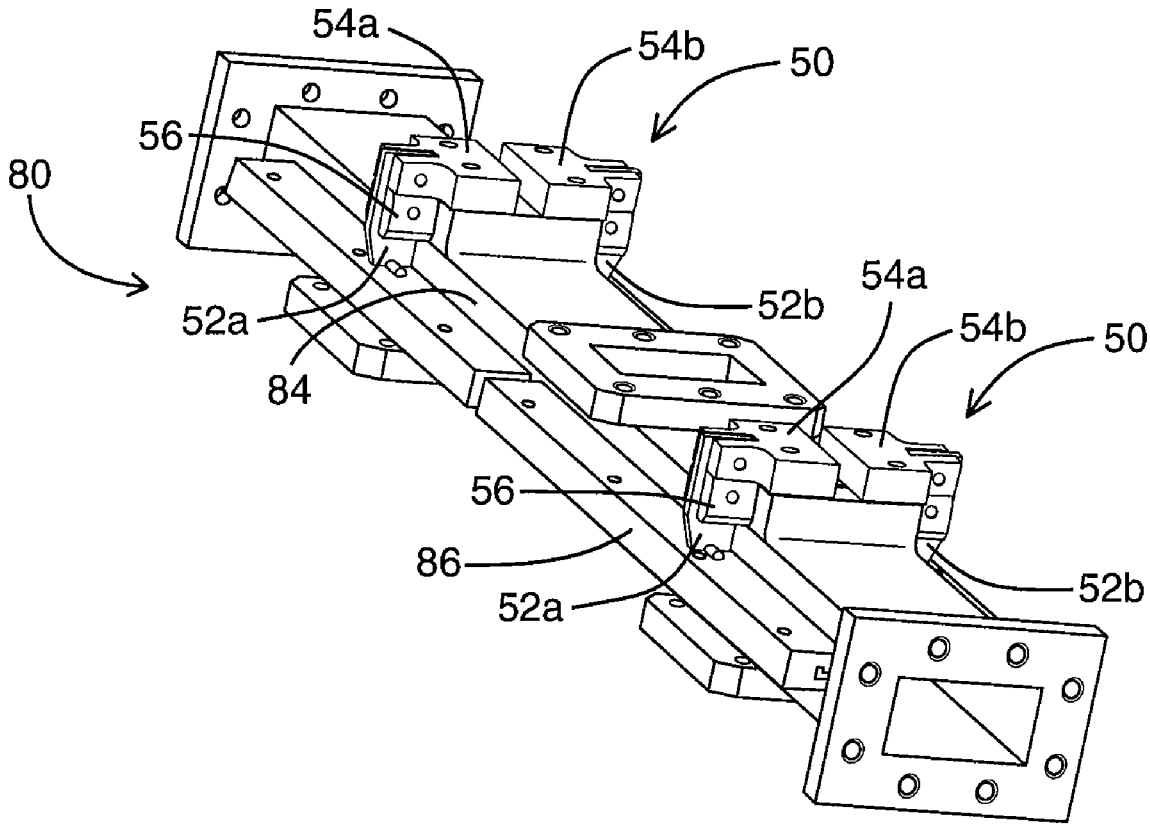
FIG. 5A is a side perspective view of two of the manifold compensation assemblies of FIG. 4 and two spreaders beam installed on a exemplary manifold.
Figure 5B:
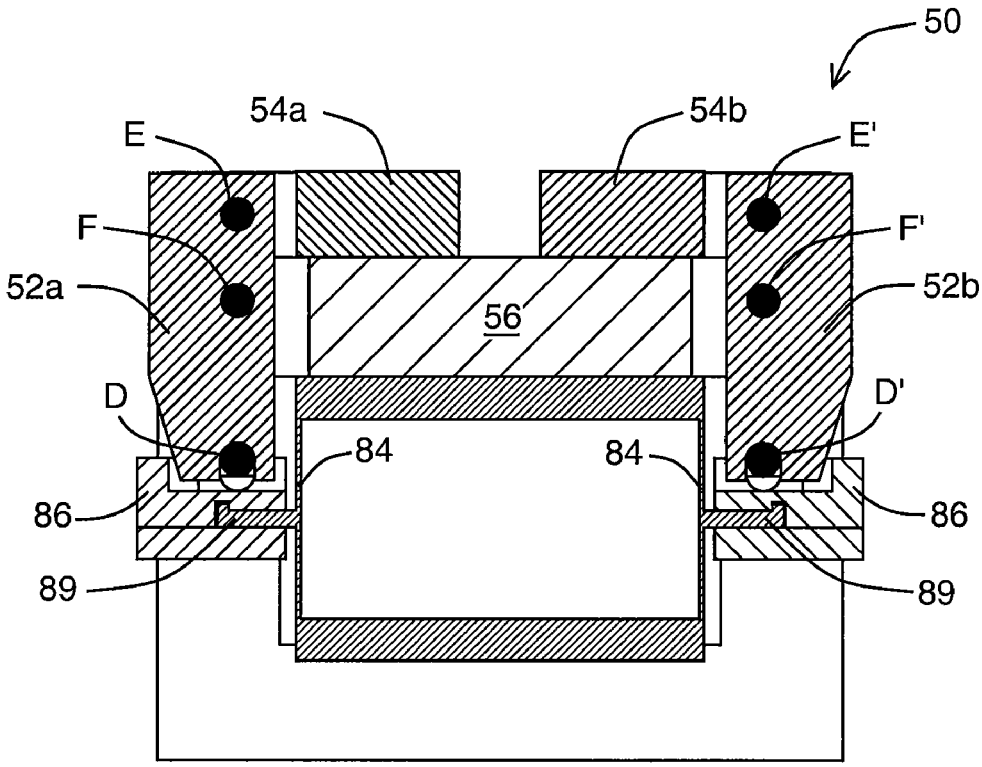
FIG. 5B is a front cross-sectional view of the manifold compensation assembly of FIG. 4 and two beam spreaders installed on a manifold in the absence of thermal expansion.
Figure 5C:
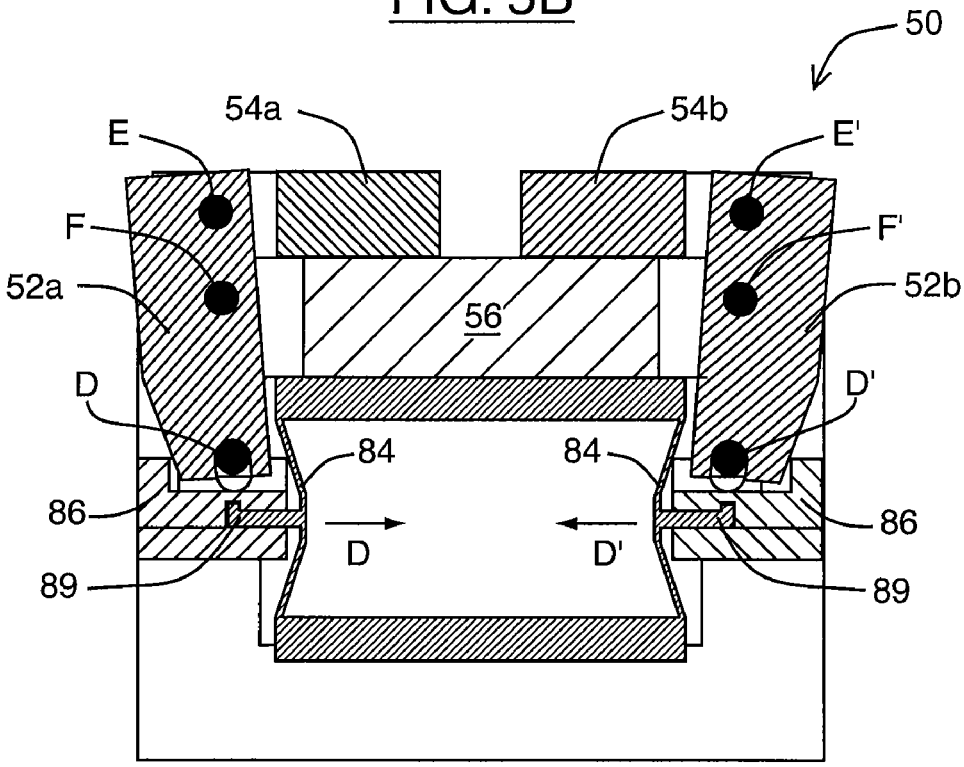
FIG. 5C is a front cross-sectional view of the manifold compensation assembly of FIG. 4 and two beam spreaders installed on a manifold in the presence of thermal expansion.

FIG. 4 illustrates a manifold compensation assembly 50 in one exemplary embodiment. The manifold compensation assembly 50 includes first and second lever elements 52*a* and 52*b*, a thermal expansion element 56, first and second anchoring elements 54*a* and 54*b*. The first and second lever elements 52*a* and 52*b* are pivotally coupled to the first and second anchoring elements 54*a* and 54*b* and to the thermal expansion element 56 and adapted to also be pivotally coupled to the narrow wall 84 of the manifold 80 through (optional) spreader beams 86 (FIGS. 5A, 5B and 5C). The manifold compensation assembly 50 is designed to deform the narrow wall 84 of the manifold 80 in the presence of increased operating temperatures, in order to negate the effects of thermal expansion, as will be described in detail.

As shown in FIG. 4, the first and second lever elements 52*a* and 52*b* are substantially flat sections with three pivot openings defined within and located at pivot points D, E and F and D', E' and F', respectively.

Each of the first and second lever elements 52*a* and 52*b* are adapted to be coupled at pivot points D and D', respectively to a spreader beam 86 mounted on a narrow wall 84 of a manifold 80 (FIGS. 5A, 5B and 5C) through pivoting connectors 60. Each of the first and second lever elements 52*a* and 52*b* are also coupled at pivot points E and E' to the first and second anchoring elements 54*a* and 54*b* through pivoting connectors 64 such that the upper extremities of the first and second lever elements 52*a* and 52*b* are constrained by the first and second anchoring elements 54*a* and 54*b*, respectively. Finally, the first and second lever elements 52*a* and 52*b* are coupled at pivot points F and F', respectively to the thermal expansion element 56 through pivoting connectors 62.

The first and second lever elements 52*a* and 52*b* are preferably manufactured out of a material with very high tensile strength and stiffness (e.g. steel). The lever elements 52*a* and 52*b* are sized sufficiently large to have negligible elastic deformation under the reaction loads from the manifold wall. In this way, the compensation rate is a function only of the geometry and the CTE of constituent parts and therefore is predictable and controllable to a high precision. The coefficient of thermal expansion (CTE) of the lever elements 52*a* and 52*b* is inconsequential because of the slotted pivot holes at the pivot points D and D' which are designed to accommodate any in-plane expansion of the manifold narrow wall. Any structural material of suitable stiffness may be employed with ANSI 440-C stainless steel being preferred because of its superior bearing qualities at the various pivot points.

As shown in FIG. 4, the first anchoring element 54*a* is coupled to the first lever element 52*a* at pivot point E and the second anchoring element 54*b* is coupled to the second lever element 52*b* at pivot point E'. The first lever element 52*a* is coupled to the thermal expansion element 56 through a pivoting connector 62 at pivot point F and the second lever element 52*b* is coupled to the thermal expansion element 56 through a pivoting connector 62 at pivot point F'. While the first and second restraining elements 54*a* and 54*b* are shown as being separate, to permit a degree of adjustment in the mechanism, it should be understood that first and second restraining elements 54*a* and 54*b* could be replaced by a single restraining element or alternatively, could be realized as a feature of the rigid broad wall of the manifold structure.

It should be noted that FIGS. 5B and 5C illustrate a cross-section which is taken through the center of the lever elements 52*a* and 52*b*. Both the restraining elements 54*a* and 54*b* and the thermal expansion element 56 thermal expansion element 56 have "forked ends" that surround the lever which are shown more markedly in FIG. 5C. It should be understood that the only physical connections between the lever elements 52*a* and 52*b*, the restraining elements 54*a* and 54*b*, and the thermal expansion element 56 are through pivot connections D, D', E, E', F, and F'.

The thermal expansion element 56 is a substantially rectangular element and has openings formed therein at pivot points F and F' (FIG. 4). The thermal expansion element 56 is coupled to and in between the first and second lever elements 52*a* and 52*b* at pivot points F and F' as shown. The thermal expansion element 56 is preferably manufactured from low CTE material such as Invar which has a range of 0.7 to 1.5 ppm/C.°. A CTE close to zero is preferred in order to remove variability in performance if the expansion element 56 attains temperatures that are different from the manifold.

Now referring to FIGS. 4, 5A, 5B and 5C, the application of the manifold compensating assemblies 50 to the narrow wall 84 of a multiplexer manifold 80 will be discussed in more detail. The multiplexer manifold 80 of this exemplary illustration is an aluminum rectangular waveguide into which a plurality of signals are injected and combined into a composite signal. The manifold 80 is sensitive to thermal expansion which alters the electrical phase differential among signal injection points as shown. The manifold compensation assembly 50 is used to adjust the larger dimension of the rectangle section of the manifold 80 through controlled deformation of the narrow walls 84 (in a direction that is opposite to the thermal expansion) such that the phase separation of the injection points remains constant as the manifold 80 expands along its longitudinal axis.

As shown, in FIG. 5A, a plurality of manifold compensation assemblies 50 are deployed along the length of the manifold 80 to maintain uniform displacement over the operating length. Optionally, two rigid steel spreader beams 86 are fitted to the narrow walls 84 of the manifold 80 (FIGS. 5A, 5B and 5C) to distribute the deforming (i.e. compensating) force provided by the manifold compensation assemblies 50 and to minimize the number of manifold compensation assemblies 50 required. The spreader beams 86 are rectangular beams having a length that is substantially equal to the length of the manifold. The spreader beams 86 each include an inside ridge 89 positioned next to the narrow wall 84 of the manifold 80. In this exemplary embodiment, the inside ridge 89 is part of the manifold wall and is there to receive and attach to the spreader beams 86. However, it should be understood that there are various methods that a spreader beam 86 could be mounted to the manifold wall in order to implement manifold compensation assemblies 50, wherein the spreader beam 86 is free to push and pull on the manifold wall but constrained to maintain contact with the manifold wall.

Each manifold compensation assembly 50 is positioned transverse to the length of the manifold such that the first and second lever elements 52*a* and 52*b* are located on opposite sides of the manifold 80. The first and second anchoring elements 54*a* and 54*b* are fixed to the manifold using standard fasteners. The first and second lever elements 52*a* and 52*b* have amplification which results from the relative spacing of the pivot points E, F, and D and E', F', and D', along the length of the first and second lever elements 52*a*.

Specifically, as the separation of E and E' increases (or decreases) due to thermal expansion (or contraction) of the rigid broad wall of the manifold, the levers rotate about F and F'. The displacement seen at D or D' exceeds the relative displacement between E and F in accordance with the ratio of lengths. That is, the difference between the thermal expansion (or contraction) of the manifold 80 and the expansion (or contraction) of the thermal expansion element 16 imparts a countervailing and larger displacement towards (or away from) the narrow wall 84 of manifold 80 that is directly proportional to the ratio of the between pivot-point lengths E-D to E-F (and E'-D' to E'-F'). Again, this lever mechanism of the manifold compensation assembly 50 amplifies the differential expansion (or contraction) of the various assembly elements, allowing for larger displacements than permitted in prior art devices, thereby accommodating greater temperature excursions that are inherent in high power applications.

As shown in FIG. 5C, when there is an increase in the operational temperature, thermal expansion element 56 expands to a lesser degree than the first and second anchoring elements 54*a* and 54*b*, and the manifold 80 to which first and second anchoring elements 54*a* and 54*b* are rigidly fastened and form part. Accordingly, the first and second anchoring elements 54*a* and 54*b* force first and second lever elements 52*a* and 52*b* apart at pivot points E and E' by a first degree. Simultaneously, since the thermal expansion element 56 expands to a lesser degree than the first and second anchoring elements 54*a* and 54*b*, thermal expansion element 56 forces the first and second lever elements 52*a* and 52*b* apart to a second degree where the second degree is less than the first degree.

Accordingly, the first and second lever elements 52*a* and 52*b* exert deforming pressure inwards at pivot points D and D' onto the spreader beams 86 which then translates into inward pressure from the inside ridges 89 on the narrow walls 84 of the waveguide 80 as shown by the arrows D and D' in FIG. 5C.

As with the filter compensation assembly 10, the manifold compensation assembly 50 has freely moving pivot points D, D', E, E', F, and F' that permit the temperature dependent mechanism to be arbitrarily stiff relative to the membrane section 84 and therefore highly deterministic in performance.

Further, as with the filter compensation assembly 10, the lever mechanism of the manifold compensation assembly 50 amplifies the differential expansion of the various assembly elements, allowing for larger displacements than permitted in prior art devices, thereby accommodating greater temperature excursions that are inherent in high power applications.

Finally, the manifold compensation assembly 50 is substantially more compact or of lower mass than other prior art solutions.

Figure 6:
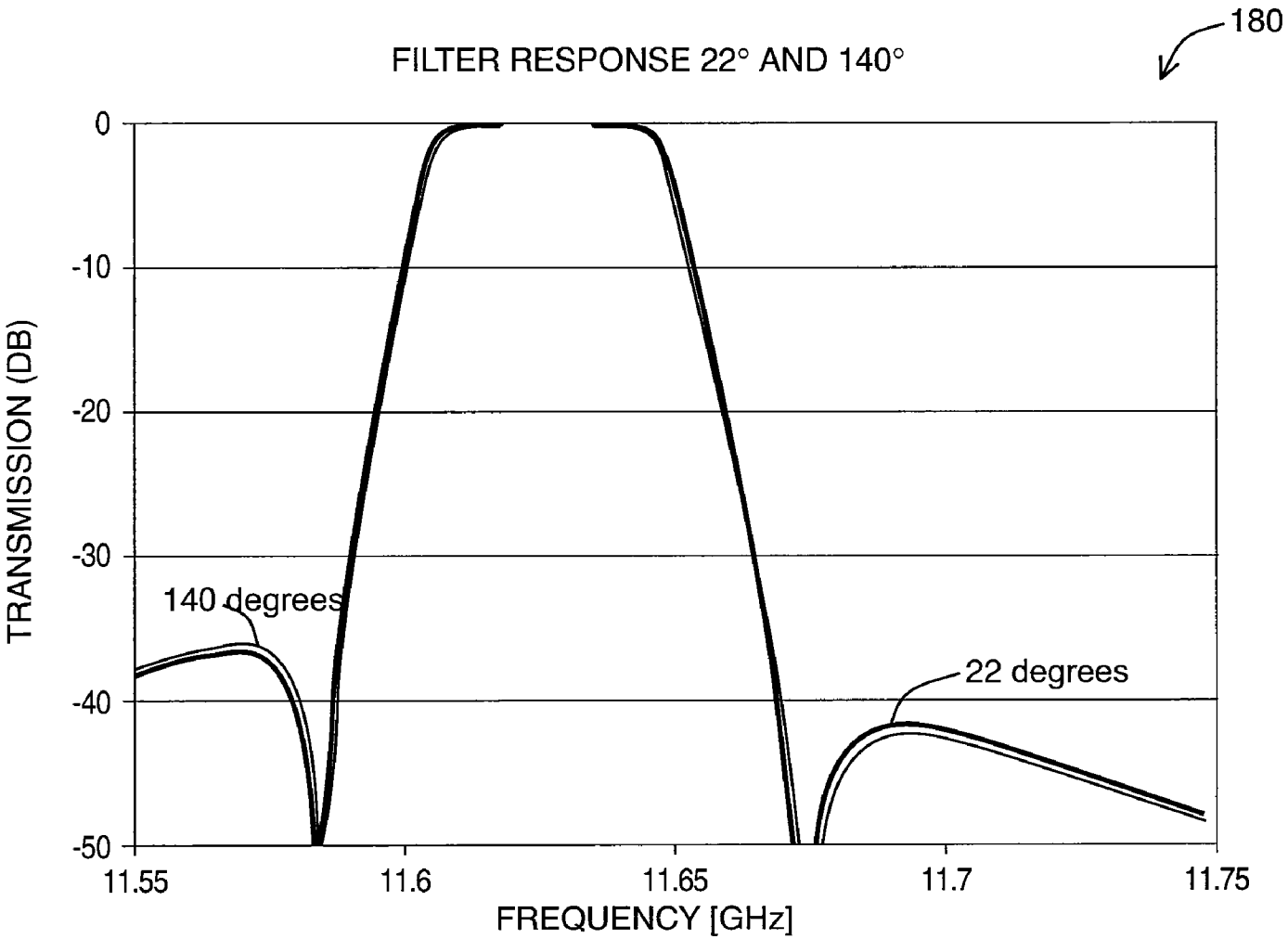
FIG. 6 is a graphical diagram that illustrates the performance of the exemplary compensated cavity filter of FIG. 3A.

FIG. 6 is a graph which illustrates superimposed response traces at ambient temperature and at 140° C. for a prototype compensated cavity filter 30 that has been constructed and tested over the illustrated temperature ranges. The effective frequency shift is 90 kHz that corresponds to an apparent CTE of 0.07 ppm/C.°. This demonstrates a thermal stability significantly better than obtained from Invar structures. The bold trace is 22° and the finer trace is 140°.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

The invention claimed is:

1. A manifold compensation assembly for thermal compensation of a manifold enclosing a rectangular waveguide, having thin and compliant narrow walls and rigid broad walls, said manifold compensation assembly comprising:

(a) first and second lever elements, each having a first pivot point at one end, a second pivot point at the other end and a third pivot point positioned in between the two ends, where the first lever element is pivotally coupled at the first pivot point to the manifold on one of the narrow walls and the second lever element is pivotally coupled at the first pivot point on the opposite narrow wall;

(b) at least one anchoring element pivotally coupled between the first and second lever elements at the second pivot points of said first and second lever elements such that the at least one anchoring element is secured to a rigid broad wall; and (c) a thermal expansion element having a coefficient of thermal expansion that is less than that of the manifold assembly, said thermal expansion element being pivotally coupled between the first and second lever elements at the third pivot points of said first and second lever elements;

(d) such that the difference in the coefficient of thermal expansion between the thermal expansion element and the manifold assembly causes the first and second lever elements to articulate and to displace the narrow wall of the manifold to achieve thermal compensation and wherein the degree of displacement of the narrow walls caused by each of the first and second lever elements is proportional to the ratio between the distance between the second and first pivot points and the distance between the second and the third pivot points.

2. The assembly of claim 1, wherein when the manifold thermally expands, the relative thermal expansion of the thermal expansion element in comparison with the manifold forces the first and second lever elements towards the narrow wall at the first pivot point on the first and second lever elements.

3. The assembly of claim 1, wherein when the manifold thermally contracts, the relative thermal expansion of the thermal expansion element in comparison with the manifold forces the first and second lever elements away from the narrow wall at the first pivot point on the first and second lever elements.

4. The assembly of claim 1, wherein the first and second lever elements contain a slotted pivot hole at the first end that is adapted to accommodate the expansion of the manifold transverse to the displacement achieved in (d).

5. The assembly of claim 1, further comprising a spreader beam and wherein the first and second lever elements are coupled to the narrow wall through the spreader beam to distribute the force provided by the first and second lever elements to the narrow wall of the manifold.

6. The assembly of claim 1, wherein the anchoring element is comprised of first and second anchoring elements, where the first anchoring element is pivotally coupled to the first lever element and the second anchoring element is pivotally coupled to the second lever element.

7. The assembly of claim 1, wherein the thermal expansion element has a coefficient of thermal expansion in the range of 0.7 to 1.5 ppm/C.°.

* * * * *